United States Patent [19]

Lonardi

[11] Patent Number: 5,009,398

[45] Date of Patent: Apr. 23, 1991

[54] DEVICE FOR REDUCING THE STRESSES ON A SEALING SHUTTER

[75] Inventor: Emile Lonardi, Bascharage, Luxembourg

[73] Assignee: Paul Wurth S.A., Luxembourg, Luxembourg

[21] Appl. No.: 448,002

[22] Filed: Dec. 8, 1989

[30] Foreign Application Priority Data

Dec. 30, 1988 [LU] Luxembourg ..... 87420

[51] Int. Cl.[5] ..... C21B 7/00

[52] U.S. Cl. ..... 266/199; 266/197

[58] Field of Search ..... 266/199, 197, 271

[56] References Cited

U.S. PATENT DOCUMENTS 3,732,993 5/1973 Csapo ..... 266/199

FOREIGN PATENT DOCUMENTS 2182213 8/1987 Japan ..... 266/271

0720023 3/1980 U.S.S.R. ..... 266/199

0735637 5/1980 U.S.S.R. ..... 266/271

0771164 10/1980 U.S.S.R. ..... 266/199

*Primary Examiner*—S. Kastler

*Attorney, Agent, or Firm*—Fishman, Dionne & Cantor

[57] ABSTRACT

An apparatus for sealing an orifice is disclosed. The apparatus includes a shutter and an annular seat. The shutter includes a shutter body and a soft peripheral gasket. The shutter has a closed position in which the gasket is laid against the annular seat, in order to ensure sealing between a medium located on the same side of the seat at a given pressure and a medium located on the opposite side at a higher pressure. The seat is associated with the pressure compensator acting on the shutter in its opening direction under the action of a hydraulic fluid, the thrust of which is adjusted so as to correspond approximately to the force acting on the shutter in its closed position and resulting from the pressure differences prevailing either side of the shutter.

9 Claims, 1 Drawing Sheet

DEVICE FOR REDUCING THE STRESSES ON A SEALING SHUTTER

TECHNICAL FIELD

The present invention relates to shaft furnaces and more particularly charging an apparatus for charging a blast furnace.

BACKGROUND OF THE INVENTION

It is known that blast furnaces are charged via a lock which is alternately put in communication with the atmosphere during its filling and with the interior of the furnace during the flow-off of the charging material. For this purpose, the flow-off orifice and the charging orifice of the lock are equipped with sealing shutters. The shutters typically include a soft peripheral gasket and are movable between a first position, wherein the gasket is laid against an annular seat surrounding the orifice, and a second position, wherein the gasket is set apart from the annular seat.

Each of these sealing shutters is actuated by a hydraulic jack or the like, the thrust of which is of the order of a few tons, depending on the size of the shutter. In addition to this hydraulic force, in the closed position, the shutter is subjected to the force resulting from the pressure differences prevailing on either side of the shutter. In fact, an atmospheric pressure prevails on the same side as the seat of each shutter, while on the opposite side the shutters undergo, in their closing direction, the pressure which prevails inside the furnace. Depending on the surface of the shutter, this pressure difference may result in a force of the order of 30 tons. Because the gaskets of the shutters are made of soft material, the seat risks biting into the gasket under the influence of this high force, to form there an annular depression conductive to deposits of dust and dirt and accelerating the wear on the gasket. Although it would be possible to cancel the hydraulic thrust on the shutters when they are in their closed position, nevertheless this measure would scarcely solve the problem because the hydraulic force is negligible as compared with the thrust arising as a result of the pressure difference.

SUMMARY OF THE INVENTION

The object of the present invention is to provide an effective device for reducing the stresses caused on the gasket of such a sealing shutter by the differential pressures.

To achieve this object, the device proposed by the present invention is characterized essentially, in its preferred embodiment, in that the seat is associated with a pressure compensator acting on the shutter in its opening direction under the action of a hydraulic fluid, the thrust of which is adjusted so as to correspond approximately to the force acting on the shutter in its closing direction and resulting from the pressure differences prevailing on either side of the shutter.

In a first embodiment, the compensator consists of a series of individual pistons accommodated in corresponding cylindrical bores within the seat.

According to another embodiment, the compensator consists of an annular piston accommodated in a corresponding annular groove within the seat.

In both cases, the active surfaces of the pistons are formed by flattened surfaces of pointed heads or teeth, so as to reduce the size of the surfaces liable to the deposit of dust and make it easier to remove the deposits laterally.

The invention also provides a circuit for controlling the pressure of the hydraulic fluid, comprising sensors for measuring the pressure difference either side of the shutter, a transmitter of a nominal signal proportional to the said difference, and a comparator for comparing a signal corresponding to the actual pressure of the hydraulic fluid with the nominal signal and for generating a control signal as a function of the result of this comparison, in order to actuate a valve for adjusting the pressure of the hydraulic fluid.

DETAILED DESCRIPTION OF THE DRAWINGS

Figure 1:
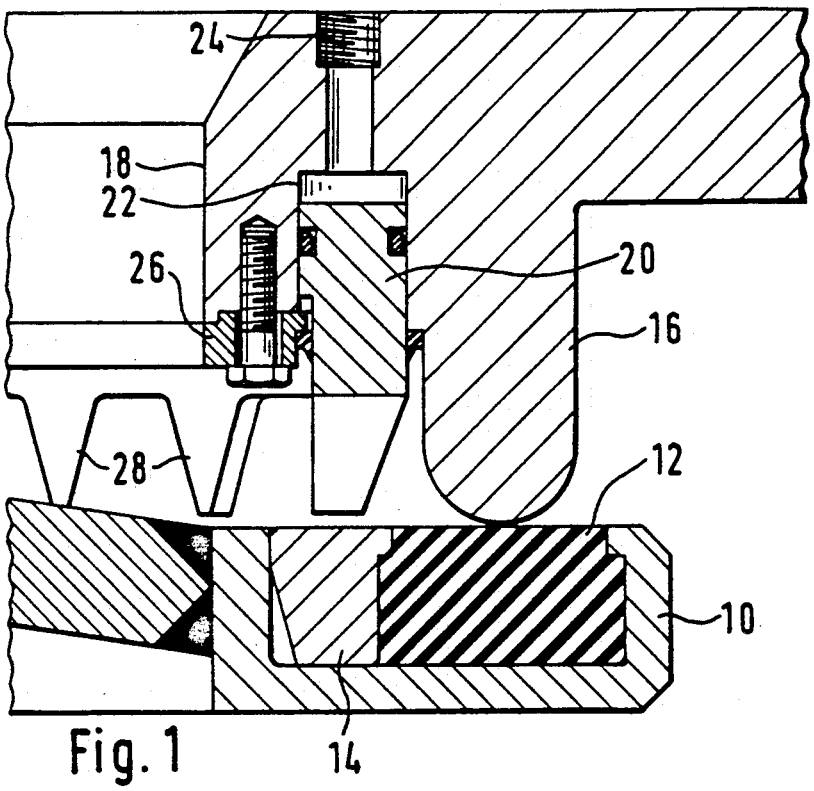
FIG. 1 shows a partial diagrammatic vertical section through a sealing shutter with a pressure compensator according to the present invention.

The present invention relates to a device for reducing the stresses on a sealing shutter. Referring to FIG. 1, a sealing shutter 10 having a soft peripheral gasket 12 wedged in a circular groove by means of an annular key 14 is shown. When the shutter 10 is in the closed position, gasket 12 is laid against an annular seat 16 surrounding a circular orifice 18.

According to the present invention, within the seat 16 there is a pressure compensator which acts on the shutter, for example in the region of the key 14, in the opening direction of the shutter 10. In the example shown, this compensator consists of an annular piston 20 which is accommodated in an annular groove 22 of rectangular cross-section and which communicates with a hydraulic control circuit via several bores 24. The piston 20 is retained in its receptacle by means of a removable flange 26.

The active surface of the piston 20 acting on the shutter 10 preferably consists of a ring of teeth 28 with a flattened head. This reduces the size of the surface liable to deposits of dust which could form a crust by being compressed between the contact surface of piston 20 and the shutter 10 and makes it easier for dust to be removed laterally so as also to ensure self cleaning.

Instead of providing a single circular piston 20 with a ring of teeth 28, it is possible to provide several cylindrical pistons, each having a pointed head acting on the shutter 10. It is likewise possible to cause several individual pistons to act on a movable flange having a ring of teeth.

Figure 2:
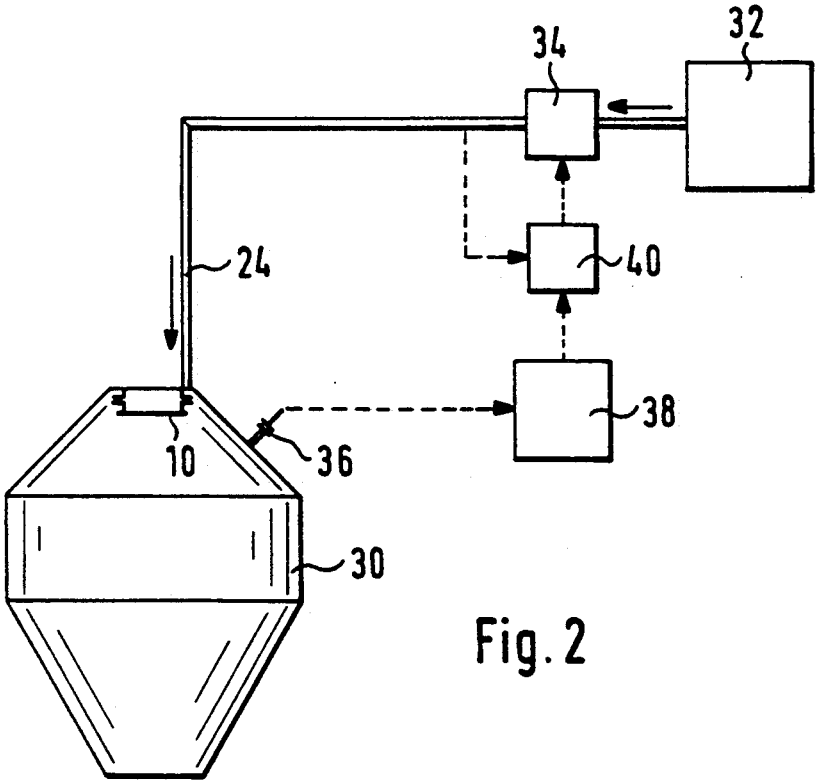
FIG. 2 shows diagrammatically a hydraulic control circuit for the pressure compensator.

FIG. 2 shows diagrammatically a hydraulic regulating and control circuit for a pressure compensator according to FIG. 1, used with the upper sealing shutter 10 of a lock 30 of an installation for the charging of a blast furnace. The feed pipes 24 of the compensator are connected to a hydraulic station 32 by means of a valve 34 for adjusting the hydraulic pressure. The circuit contains a pressure sensor 36 which measures the pressure inside the lock 30 and which transmits a signal representing this pressure to a transmitter 38. On the basis of this signal, this transmitter 38 generates a nominal signal which is a function of the pressure inside the lock 30, this being the only variable in a given installation. This nominal signal is transmitted to a comparator 40 which compares the actual pressure of the hydraulic fluid acting on the compensator 16 with the nominal pressure and which controls the adjusting valve 34 as a function of the result of this comparison, in order to increase or reduce the pressure of the hydraulic fluid, until the pressure force of the comparator 20 on the shutter 10 approximately compensates the force resulting from the pressure inside the lock 30 on the shutter 10, leaving the shutter subjected only to the force of its drive mechanism.

The lower sealing shutter (not shown) associated with the flow-off orifice of the lock 30 is equipped with a similar compensator actuated by means of a control circuit like that illustrated in FIG. 2.

Because, in the particular use in question, the ambient pressure acting on the shutter on the same side as the compensator is the atmospheric pressure, a single sensor is sufficient to measure the pressure on the opposite side of the shutter 10. If, in another use, the pressure did not correspond to atmospheric pressure, two sensor would have to be provided in order to measure the ambient pressures acting on the shutter on either side in its closing position.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for sealing an orifice of a blast furnace, said orifice being defined by a wall, said wall having a first side and an opposed second side, said orifice extending through the wall in a first direction from the first side of the wall to the second side of the wall, comprising:

an annular seat disposed on the first side of the wall and surrounding the orifice;

a shutter for sealing the orifice, comprising:

a shutter body having opposed first and second sides, a gasket secured to the second side of the shutter body, said shutter being movable between a closed position, wherein the gasket is disposed in contact with the annular seat to seal the orifice, and an open position, where in the gasket is set apart from the annular seat; and pressure compensating means for reducing stresses on the gasket while the shutter is maintained in the closed position by urging the shutter in a second direction when the shutter is in the closed position, said second direction being opposite the first direction.

2. The apparatus of claim 1, wherein, in the closed position, the shutter separates a fluid at a first pressure disposed on the first side of the wall from a fluid at a second pressure disposed on the second side of the wall, the first pressure is higher than the second pressure and a first force, arising from the difference between the first and second pressures, urges the shutter in the first direction and toward the seat and wherein the pressure compensating means urges the shutter in the second direction and away from the seat by applying a second force to the shutter in the second direction.

3. The apparatus of claim 1, wherein the annular seat includes an annular groove, and the pressure compensating means comprises an annular piston slidably received with the annular groove.

4. The apparatus of claim 3, wherein the piston comprises a ring of teeth for contacting the second side of the shutter and wherein each of the teeth has a flattened tip.

5. The apparatus of claim 1, wherein the annular seat includes a plurality of circumferentially spaced cylindrical bores and the pressure compensating means comprises a plurality of pistons, wherein each piston is slidably received within one of the cylindrical bores.

6. The apparatus of claim 5, wherein each piston comprises a conical head having a flattened tip for contacting the second side of the shutter.

7. The apparatus of claim 5, wherein each piston contacts a movable flange, said flange comprising a ring of teeth for contacting the first side of the shutter, wherein each of the teeth has a flattened tip.

8. The apparatus of claim 2, wherein the pressure compensating means comprises:

hydraulic means for applying the second force to the shutter;

sensor means for sensing the difference between the first pressure and the second pressure;

transmitter means for transmitting a first signal proportional to the sensed difference;

comparator means for comparing a second signal, said second signal being indicative of the magnitude of the second force, to the first signal;

control means, responsive to the comparator means, for generating a control signal for adjusting the magnitude of the second force.

actuator means, responsive to the control means, for adjusting the magnitude of the second force.

9. The apparatus of claim 8, wherein the second force is about equal to the first force.

* * * * *